United States Patent [19]

Fallen

[11] 3,977,421

[45] Aug. 31, 1976

[54] BUFFING MACHINE

[76] Inventor: Burke R. Fallen, 166 Santa Clara Ave., Oakland, Calif. 94610

[22] Filed: Apr. 19, 1973

[21] Appl. No.: 352,613

[52] U.S. Cl. ..... 134/6; 15/98

[51] Int. Cl.[2] ..... A47L 11/162

[58] Field of Search ..... 15/49 R, 49 C, 50 R, 15/50 C, 79, 98, 230; 51/177; 123/120; 134/6

[56] References Cited

UNITED STATES PATENTS

| | | | |
|---|---|---|---|
| 1,434,109 | 10/1922 | Finnell | 15/49 R |
| 2,301,164 | 11/1942 | Mall | 51/177 |
| 2,765,483 | 10/1956 | LeBlanc | 15/49 C |
| 3,114,358 | 12/1963 | Kauffmann et al. | 123/120 |
| 3,171,151 | 3/1965 | Sickle et al. | 15/118 |
| 3,443,551 | 5/1969 | Laubach | 123/120 X |
| 3,452,486 | 7/1969 | Lombardo et al. | 51/177 |
| 3,550,179 | 12/1970 | Brown et al. | 15/98 |

FOREIGN PATENTS OR APPLICATIONS

| | | | |
|---|---|---|---|
| 510,503 | 3/1955 | Canada | 15/49 R |
| 1,058,048 | 11/1953 | France | 15/49 R |
| 2,036,935 | 12/1970 | France | 15/230 |

*Primary Examiner*—Edward L. Roberts
*Attorney, Agent, or Firm*—Warren, Chickering & Grunewald

[57] ABSTRACT

Buffing machine comprising rotary buffing element, internal combustion engine motor for driving the buffing element and fuel tank for liquefied gas with suitable connections to supply fuel to motor.

2 Claims, 7 Drawing Figures

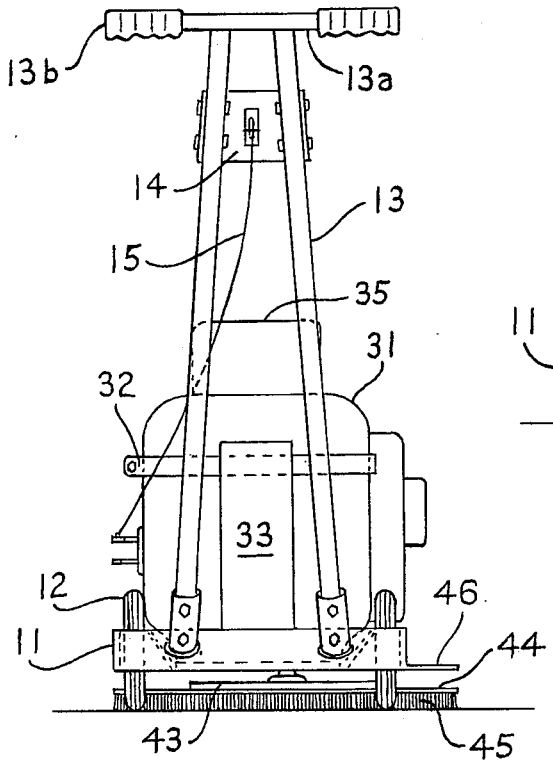
FIG. 4
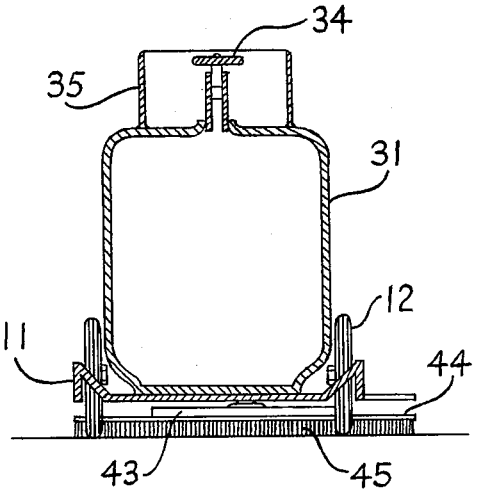
FIG. 6
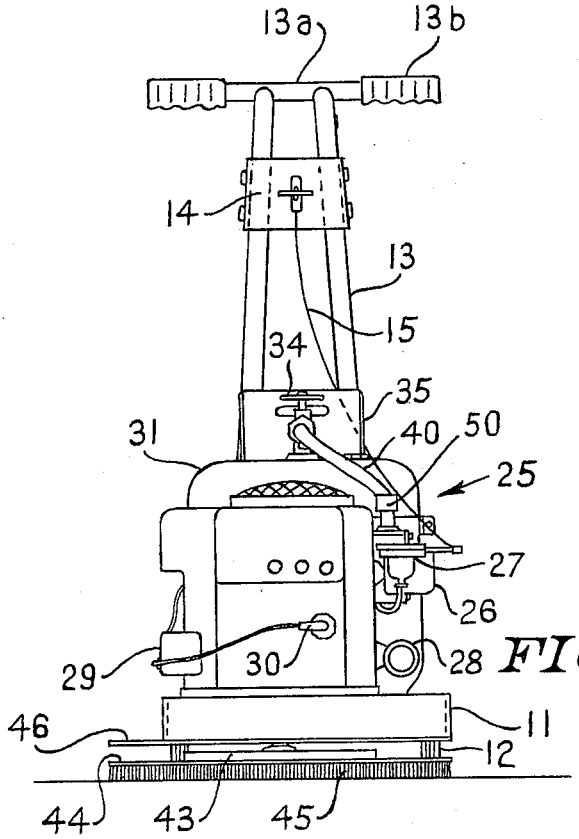
FIG. 5
FIG. 7
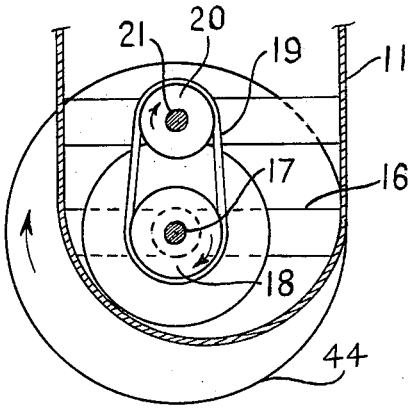

BUFFING MACHINE

This invention relates to a buffing machine of the type used to buff wood, linoleum, asphalt tile and other floors, more particularly in large commercial and institutional premises such as grocery stores, other retail establishments, schools, etc.

Heretofore, it has been common practice to employ as a buffing machine for such purposes a machine which is operated by an electric motor. Such machines work at relatively slow speed, and they require the application of a spray of liquid wax and buffing of the floor before the wax is dry.

It is an object of the present invention to provide improvements in buffing machines.

It is a further and particular object of the invention to provide a buffing machine capable of rapid buffing, which does not require a wet surface.

The above and other objects of the invention will be apparent from the ensuing description.

One embodiment of the invention is shown by way of example in the accompanying drawings, in which:

FIG. 4 is a rear view;

FIG. 5 is a front view;

FIG. 6 is a section taken along the line 6—6 of FIG. 2; and

FIG. 7 is a section taken along the line 7—7 of FIG. 1.

Figure 1:
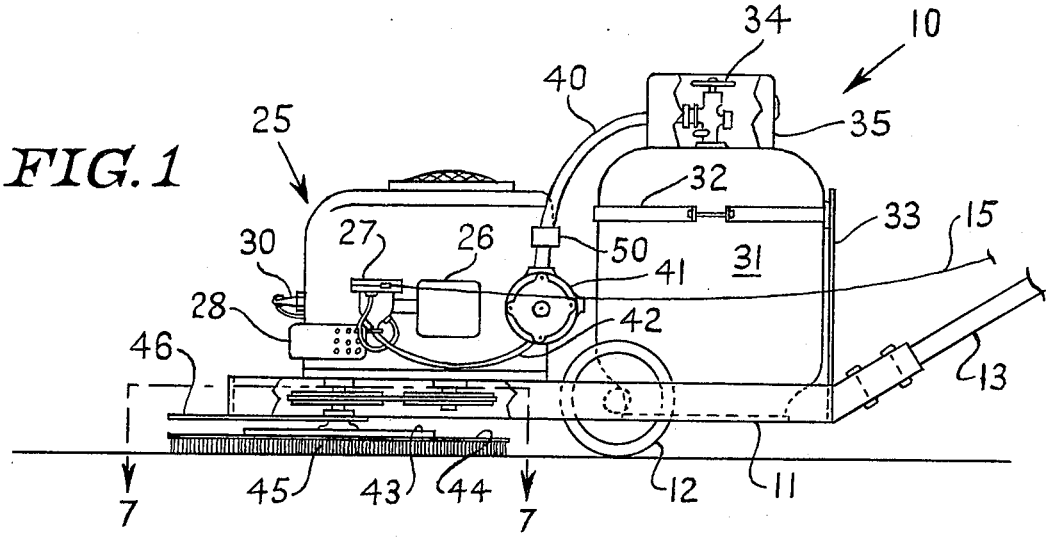
FIG. 1 is a view in side elevation of the buffing machine of the invention.
Figure 2:
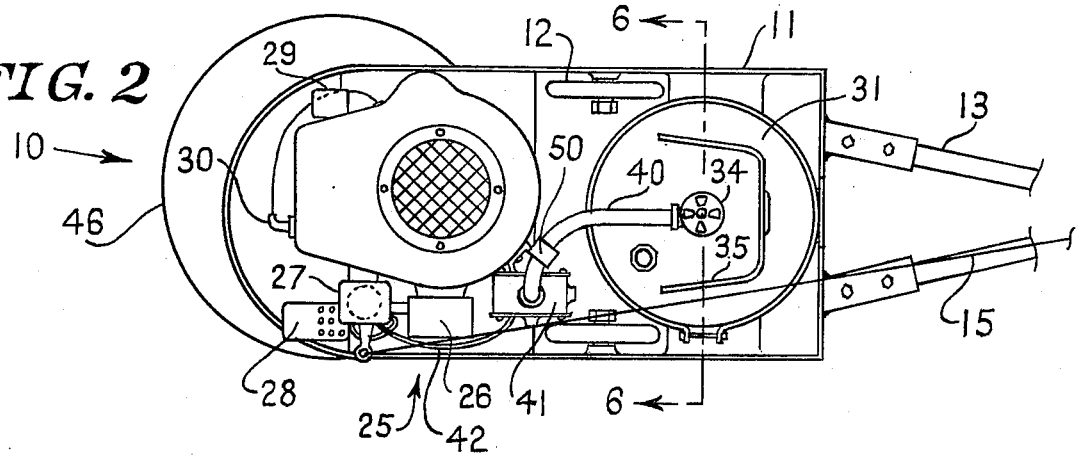
FIG. 2 is a top plan view of the same.
Figure 3:
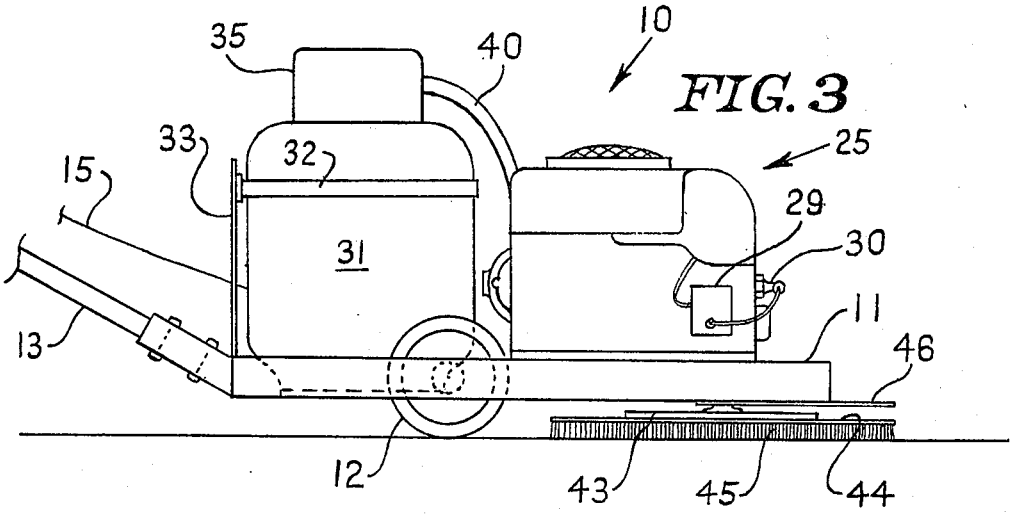
FIG. 3 is a view in side elevation from the other side with respect to FIG. 1.

Referring now to the drawings, and preliminarily to FIGS. 1, 2 and 3, the machine is generally designated by the reference numeral 10 and it comprises a rectangular frame 11 on which are mounted traction wheels 12 which engage the floor or surface to be buffed or along which the machine travels. Also shown is a handle 13 having a crosspiece **13*a* with hand grips 16*b*. At 14 there is shown a panel with controls, primarily a throttle lever which is connected by a wire 15** to the caburetor.

A cross member 16, best shown in FIG. 7, is fixed to the frame 11 and supports a bearing in which a shaft 17 is journalled to support a driven pulley 18, which is connected by a belt 19 to a driving pulley 20 which is mounted on a motor shaft 21. The diameter of the pulley 18 is preferably about twice that of the pulley 20 whereby a speed reduction is provided.

An air-cooled internal combustion motor 25 is provided which is suitably mounted on the frame and is of the reciprocating piston type of known construction and is suited to operate on a liquefied gas such as liquid propane as a fuel. The motor 25 is equipped with an air intake and filter 26, a caburetor 27, an exhaust 28 and an air vent 29 for air cooling of the motor. As shown in FIG. 3, the motor is also provided with an electric starting motor 29 and a spark plug 30, such being suitably wired to the electrical system of the machine.

A fuel tank 31 is provided which is mounted on the frame of the machine and secured by a strap 32 to an upright bracket 33. At its top the fuel tank 31 is provided with a valve 34 enclosed within a guard 35, such valve being a handoperated valve which is kept closed when the machine is not operating. When it is desired to start the machine the valve 34 is opened. Propane vapor passes through the valve 34 and a hose 40 to a pressure regulator 41 which delivers propane at a reduced pressure through a line 42 to the carburetor 27. The aforementioned shaft 17 is secured to a disc 43 which, in turn, is affixed to a plate 44 which, preferably, is an aluminum disc detachably connected to a hard board disc to which a conventional disc-shaped fibrous buffing pad 45 is attached, such pad being, for example, of the hog's hair type. A fixed stationary guard plate 46 is provided which is off center with respect to the shaft 17, so that it projects outwardly to the same extent or slightly farther than the plate 44 and abrasive element 45. The purpose of having the buffing member 44, 45 project outwardly from the frame 11 (which is more clearly shown in FIG. 7) is to permit the buffing element to reach under raised surfaces such as lockers, desks, furniture and the like. The purpose of the off center plate 46 is to act as a guard to prevent the rapidly rotating abrasive member from doing damage to animate and inanimate objects.

There is also shown at 50 an automatic shut-off device which in case the buffing machine is started by house current by means of an extension cord and plug (not shown) is connected by suitable means (not shown) to the intake of the motor and comprises a normally closed valve which remains open when subjected to the vacuum created by the motor during its operation. As a result, when the motor stops the aforementioned valve automatically closes, thus shutting off flow of propane vapor (or other fuel vapor) from the tank 21. Valves of this type are well known and require no further or detailed description herein. In the event that a buffing machine is battery operated, the valve 50 may be one which is electrically operated and which has a normal (non-energized) closed condition, but when the electric current from the battery is supplying current to the motor the circuit is such that this valve is held in open position. Therefore, when the motor stops, the valve embodied in the device 50 will automatically close and will shut off flow of fuel vapor from the tank.

It will be apparent that a useful and advantageous buffing machine is provided. This buffing machine is capable of carrying out buffing operations at very high speed, up to about 1,000 RPM much higher than electrically operated buffing machines which conventionally operate at up to about 180 RPM. Moreover, it is easily operable at high speed on a dry wax surface, such as the conventional extra hard, so-called non-buffable finishes. The present polishing technique does not require application of a spray of wax to the floor and buffing immediately thereafter before the wax coating dries or otherwise wetting the floor surface preparatory to buffing as is the common practice. Since the machine operates on a liquefied gas such as liquid propane, it does not pollute the atmosphere with products of combustion and may be used indoors. The only electrical apparatus required is that needed to start the motor and supply spark ignition; therefor, the machine can be started by an extension cord from normal 110 volt house current, or it can be started off of a battery.

Among the advantages of the machine of the present invention is the fact that many of the components may be standard, stock items such as the fuel tank, the motor, the pressure regulating valve, the automatic shut-off valve, the motor and its accessory equipment such as the carburetor and starting motor, etc.

I claim:

1. A buffing machine for polishing floors having a hard, nominally non-buffable finish thereon comprising:

a wheel mounted support adapted for movement over the floor surface to be buffed;

a disc-shaped fibrous buffing pad mounted on said support for rotation about the center of said pad and in floor surface engaging position;

an internal combustion motor mounted on said support and connected for rotationally driving said pad at an operating speed of up to at least about 1,000 RPM, said motor being fueled by liquid gas;

a liquid gas fuel tank carried by said support; and a valve and fuel supply line connecting said tank and motor for controlling the operation of said motor.

2. A method of polishing indoor floors having a hard, nominally non-buffable finish material thereon comprising:

applying to said finish material a disc-shaped fibrous buffing pad; and revolving said pad about its center by means of a liquified gas driven internal combustion motor and with said pad in contact with said material and at an operating speed of at least about 1,000 RPM.

* * * * *